US005906217A

United States Patent [19]

Hill

[11] Patent Number: 5,906,217

[45] Date of Patent: May 25, 1999

[54] COLLAPSIBLE BALE BLIND

[76] Inventor: Curtis J. Hill, HC01, Box 26, Warba, Minn. 55793

[21] Appl. No.: 09/040,057

[22] Filed: Mar. 17, 1998

[51] Int. Cl.[6] ..... E04H 15/36

[52] U.S. Cl. ..... 135/124; 135/132; 135/136; 135/143; 135/901; 43/1

[58] Field of Search ..... 135/124, 128, 135/132, 136, 137, 138, 901, 143, 153; 43/1

[56] References Cited

U.S. PATENT DOCUMENTS

| | | | |
|---|---|---|---|
| 3,820,805 | 6/1974 | Tuomala | 135/901 X |
| 4,067,347 | 1/1978 | Lipinski | 135/901 X |
| 4,794,717 | 1/1989 | Horsmann | 43/1 |
| 5,033,493 | 7/1991 | Senchuck | 135/113 |
| 5,343,887 | 9/1994 | Danaher | 135/128 X |
| 5,368,057 | 11/1994 | Lubkeman et al. | 135/901 X |
| 5,458,079 | 10/1995 | Mattews et al. | 135/901 X |

OTHER PUBLICATIONS

Article entitled "Tactics & Gear", Ducks Unlimited, p. 60.

*Primary Examiner*—Carl D. Friedman
*Assistant Examiner*—Winnie Yip
*Attorney, Agent, or Firm*—Mackall, Crounse & Moore, PLC

[57] ABSTRACT

A collapsible portable bale shaped field blind for wildlife observers and hunters generally includes a cylindrical and collapsible tubular frame supported upon a sled-like base. The frame, when fully extended, has a cylindrical shape much like that of a hay bale. In a collapsed shape, the frame is completely folded down suitably into a sled base. The frame has a camouflage waterproof fabric fastened there over and cooperates with the folding of the frame. A stand-up hatchway which is covered by a camouflaged arcuate door frame is pivotally mounted on the top of the collapsible frame. A stretch cord is provided which biases the arcuate door frame into either the fully open or fully closed position. Windows and viewing slots are also provided.

20 Claims, 5 Drawing Sheets

94
90
92
80
56
30
92
58
50
62
56
54
64
60
80
70
60
68
70
68
52
50
32
54
38
36
34

COLLAPSIBLE BALE BLIND

BACKGROUND OF THE INVENTION

This invention generally relates to a blind for hunting, and more particularly, relates to a bale-shaped camouflage blind that is collapsible as well as readily portable.

Hunting big game, water fowl and other wildlife requires that the hunter or observer be concealed and protected as to not disturb the wild animals and yet be safe and comfortable from the elements. Thus, hunters and wildlife observers over the years have built blinds in which to conceal themselves as well as to keep them warm, dry and out of the wind.

However, wildlife will often shift patterns due to food availability, weather and patterns of other similar wild game which may include reproduction. As a consequence, tent or hut-like blinds were developed and used, often made of material having a camouflage pattern. However, such constructions still did not look natural, at least in their shape, and discouraged wildlife from approaching. These prior constructions were and are clumsy and awkward to set up taking considerable time.

For at least the past fifteen years, wildlife and water fowl have become used to seeing large, cylindrical hay bales up and down fields and flyways. Animals sense no danger when seeing an image commonly found along their pathways and migration routes. Hunters have constructed such round hay bale-like blinds of wire or screen with actual vegetation attached to the outside of the artificial bale blind. However, such blinds were awkward, not collapsible nor transportable.

There is a need for a collapsible portable hay bale shape blind that will keep the hunter and wildlife observer warm, dry and out of the wind. Such a blind should be cylindrical in shape and should simply and quickly fold back down onto itself or into a sled. The blind should carry gear placed on top of the collapsed blind for transportation in and out of the field. Wildlife and birds should sense no danger when looking upon this commonly found image portrayed by a hay bale blind.

SUMMARY OF THE INVENTION

A collapsible portable bale shaped field blind for wildlife observers and hunters generally includes a cylindrical and collapsible tubular frame supported upon a sled-like base. The frame, when fully extended, has a cylindrical shape much like that of a hay bale. In a collapsed shape, the frame is completely folded down suitably into a sled base. The frame has a camouflage waterproof fabric fastened there over and cooperates with the folding of the frame. A stand-up hatchway which is covered by a camouflaged arcuate door frame is pivotally mounted on the top of the collapsible frame. A stretch cord is provided which biases the arcuate door frame into either the fully open or fully closed position. Windows and viewing slots are also provided.

A principal object and advantage of the present invention is that the hay bale cylindrically-shaped blind is readily, quickly and easily collapsible and portable and is also suitable for carrying additional equipment to and from the field.

Another object and advantage of the present invention is that viewing windows and slots are available to allow a viewing 360° from within the blind.

The second object and advantage of the present invention is that the collapsible frame has unique arcuate side bows which simply pivot inwardly and outwardly to complete the cylindrical shape of the end supports heretofore not known.

Another object and advantage of the present invention is that its base may be of a polyethylene sled-like design to keep both the humans inside the blind and equipment dry when the ground is wet or marshy.

Another object and advantage of the present invention is that the arcuate door frame is biased and urged into either an open or closed position permitting the hunter to simply apply slight pressure upwardly and the door frame will spring open to expose the stand up hatchway.

Another object and advantage of the present invention is that it is lightweight and portable and therefore easy to position or relocate depending upon the wildlife patterns or weather.

Another advantage of the present invention is that the individuals within the blind are kept warm, dry and out of the wind rather than lying on the ground getting cold, wet or developing a stiff neck.

Another object and advantage of the present invention is that the bale blind is extremely lightweight, folds down into its base or sled bottom four inches in height and is easily towed around by a young person with a sled rope.

Other objects and advantages will become readily apparent upon the reading of the specification and a review of the accompanying figures.

DETAILED SPECIFICATION

Figure 1:
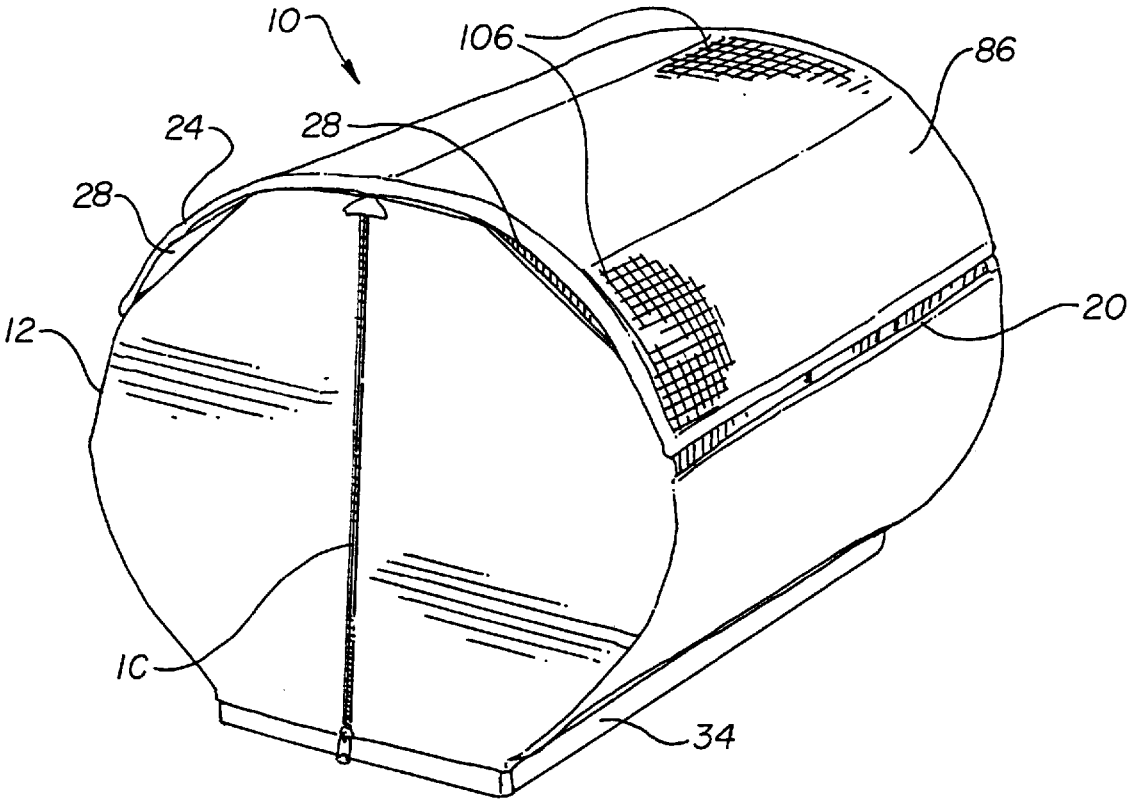
FIG. 1 is a side front perspective of the collapsible portable hay bale field blind of the present invention in its assembled state.
Figure 2:
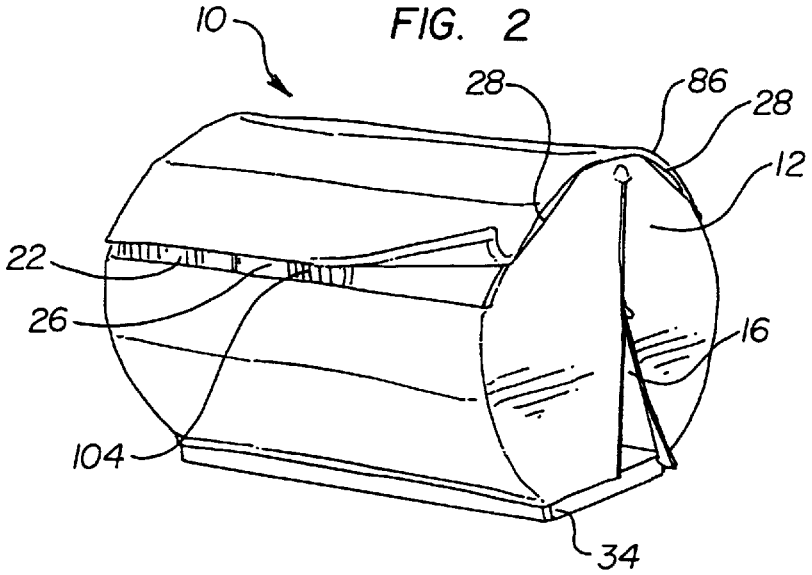
FIG. 2 is a rear side perspective view of the hay bale blind with one side door and the rear window flap partially opened.
Figure 3:
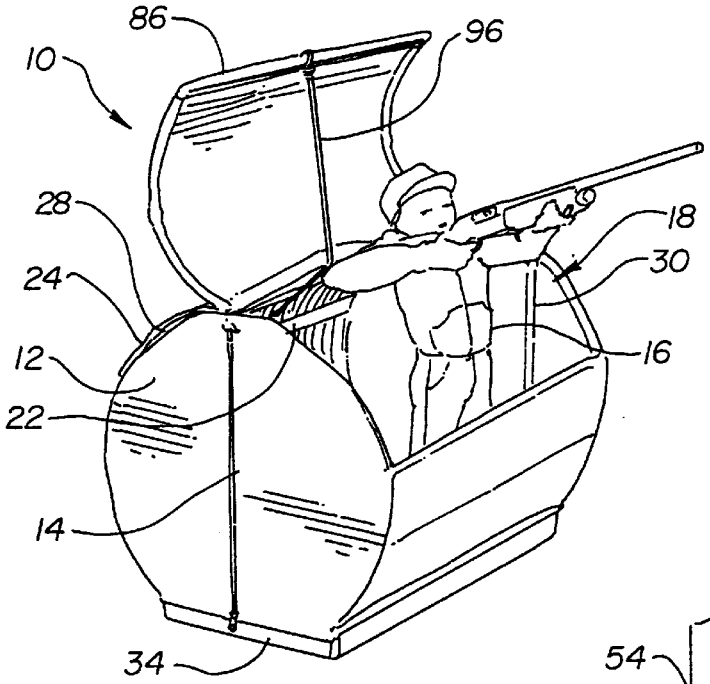
FIG. 3 is a side front elevational view with the spring loaded hatch door opened and a hunter standing upright ready to shoot.

Referring to FIGS. 1 through 3, the collapsible and portable hay bale field blind 10 may be generally seen and appreciated. The blind 10 has a collapsible frame 30 which is suitably in a hay bale or cylindrical shape when erect. The frame 30 is pivotally secured to the sled base 34 after which is secured thereabout a camouflage waterproof fabric 12. The blind 10 has a right zipper door 14 and a left zipper door 16. A stand-up hatchway 18 is provided which is closed by a pivotally mounted spring loaded hatch door 86. The field blind 10 has a front viewing slot 20, rear window 22, rear window flap 24, rear view slot and side or end wall viewing slots 28.

Figure 5:
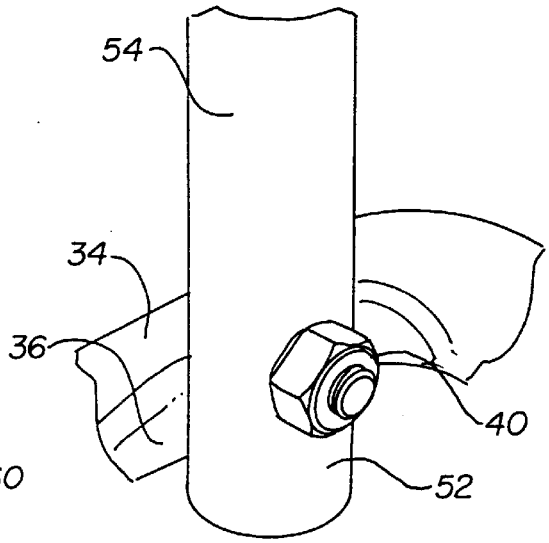
FIG. 5 is an enlarged broken away perspective view of the pivotal fastening means of the U-shaped support ends to the sled bottom.
Figure 6:
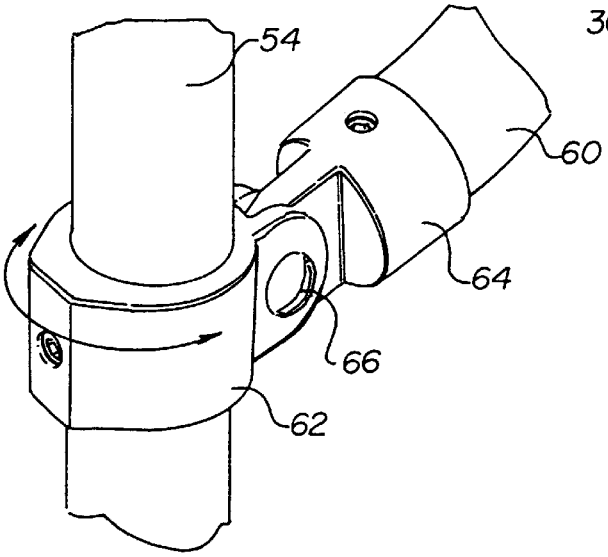
FIG. 6 is a broken away view of the rotatable fastener between the arcuate side bows and inverted U-shaped end supports.
Figure 4:
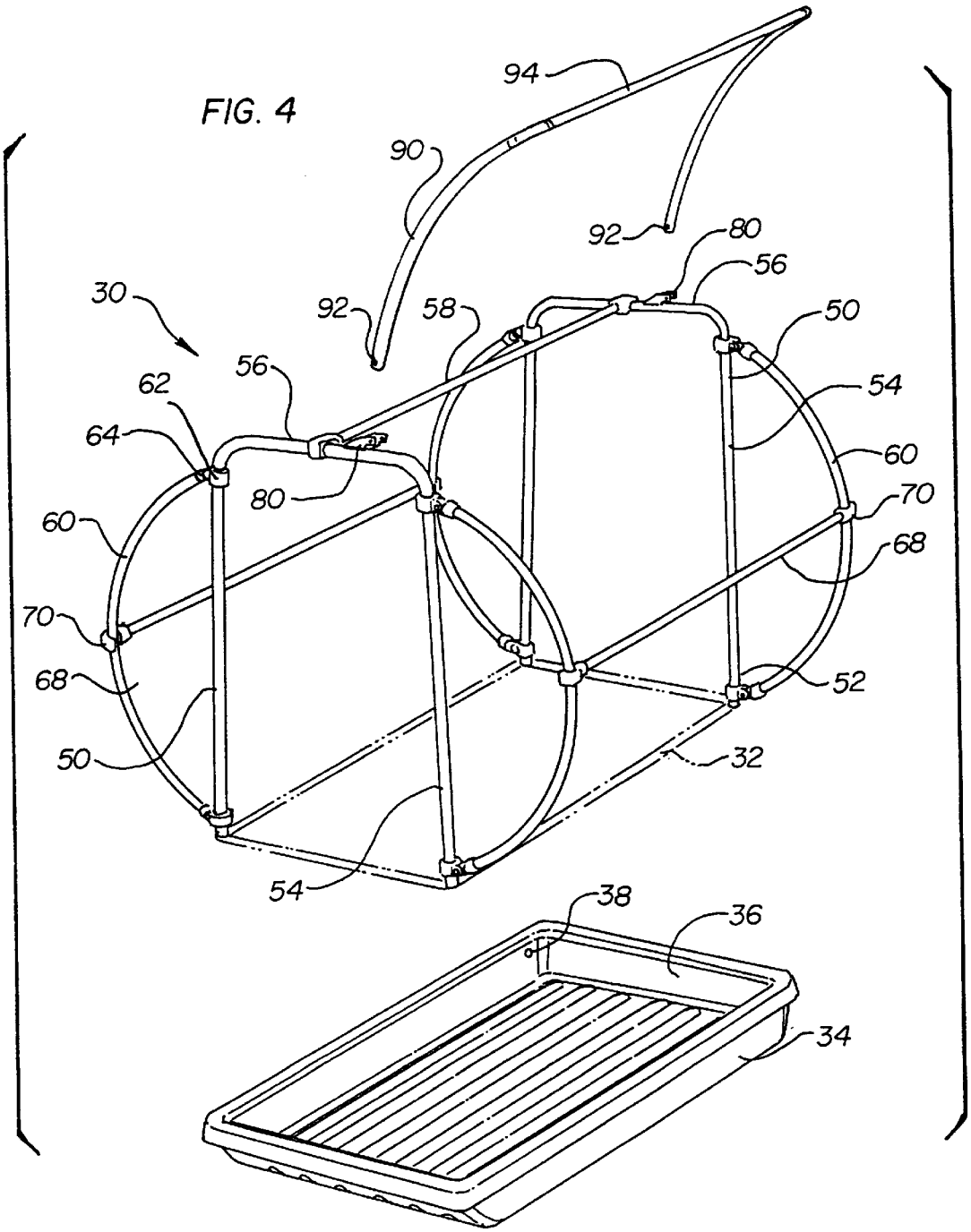
FIG. 4 is an exploded perspective view of the collapsible frame and sled base without the camouflage covering showing an optional rectangular base frame in broken outline.

More specifically referring to FIGS. 4 through 8, the collapsible frame 30 of the field blind 10 may be understood. The collapsible frame 30 must be of a generally cylindrical or bale shape for it to have a look like a hay bale. The frame 30 is suitably made from aluminum or stainless steel metal tubes which offer significant strength, yet are still lightweight. The frame 30 may have an optional rectangular base 32 or a plastic sled like base 34 which suitably may be made of plastic polyethylene. The sled floor 34 provides the advantage of keeping the interior of the field blind 10 dry. The collapsible frame 30 is secured to the side walls 36 of the sled 34 suitably by the combination of apertures 38 in the side walls 36 and bolts with nuts passing through the base ends 52 (FIG. 5).

The inverted U-shaped end supports 50 pivot inwardly and downwardly into the sled floor 34. The inverted U-shaped end supports 50 have base ends 52, vertical sections 54 and a top arch portion 56. When the end supports 50 are in their upright position, a top support strut 58, suitably with snap on ends, will hold the end supports 50 in a substantially vertical condition.

The arcuate side bows 60 are secured to the vertical portions 54 of the end supports 50 by rotatable fasteners 62. The fasteners 62 suitably rotate on the vertical sections 54 and support a double flange for capturing the single flange of the end cap 64 suitably mounted on the ends of the arcuate side bow 60. A screw 66 secures the flanges together. When the arcuate side bows are folded outwardly, side support struts 68, with snap on ends 70, secure the side bows 60 into a bale-like condition.

Figure 9:
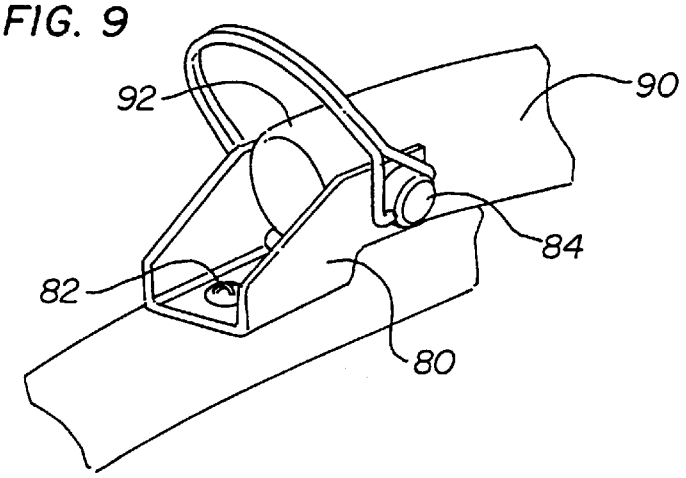
FIG. 9 is an enlarged broken away perspective view of the hinge assembly for the hatchway door.

Hinges 80 is suitably mounted on the top arch portions 56 of both end supports 50 and held thereat by screws 82. A releasable pivot pin 84 may be captured by the hinge 80 for mounting of the hatch door 86 (FIG. 9).

Hatch door 86 is suitably made from arcuate door frame 90 having pivot ends 92 and a continuous front cross bar 94, all of which are covered by the camouflage waterproof fabric 12. Once the hatch door 86 is pivotally mounted, a stretch cord 96 extends from the front cross bar 94, over the top support strut 58 and down to the rear support strut 68.

Rear window flap 98 is suitably a secured portion of the camouflage fabric 12 and appropriately has two horizontally extending sleeves 100 containing metal rods 102 to weigh the flap in its downward closed position. A securement flap 104 may be provided connecting the flap 98 to the rear side support strut 68.

Figure 7:
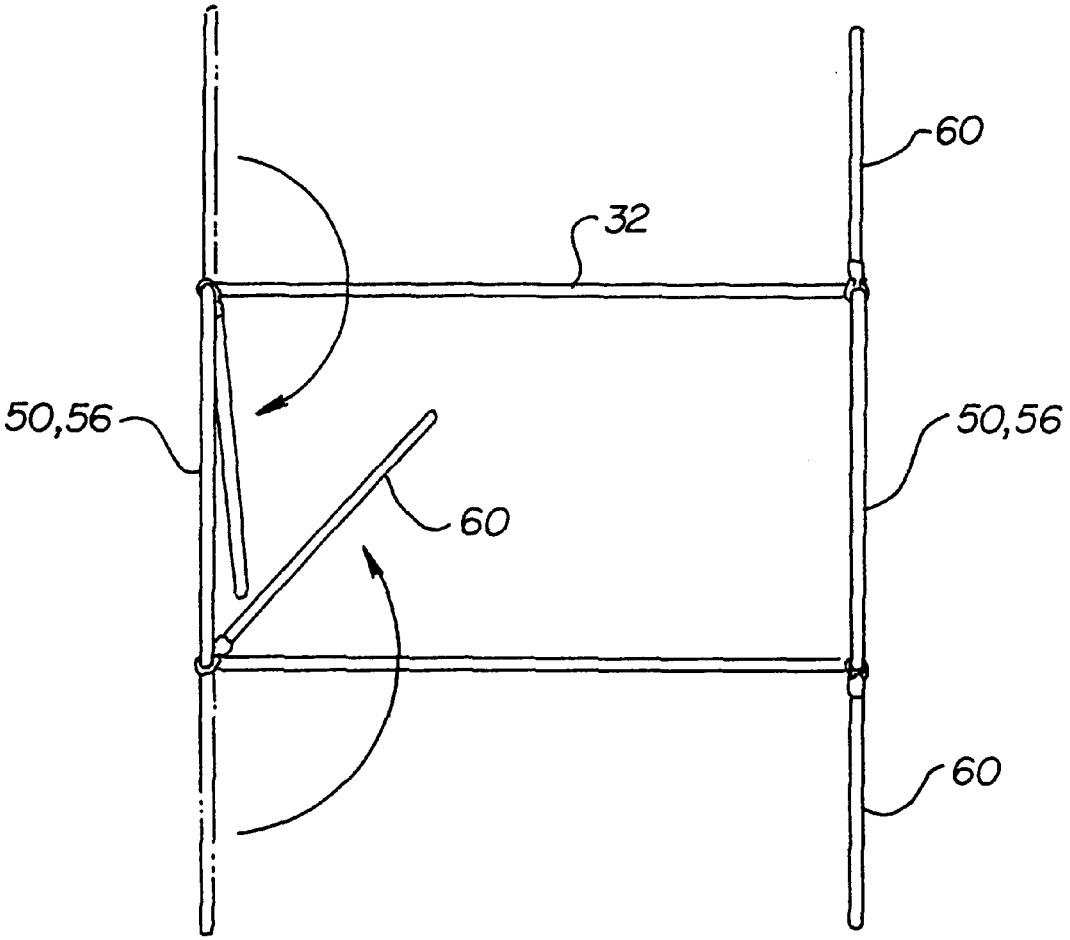
FIG. 7 is a top plan view of the collapsible frame beginning to be folded for collapse and transportation.
Figure 8:
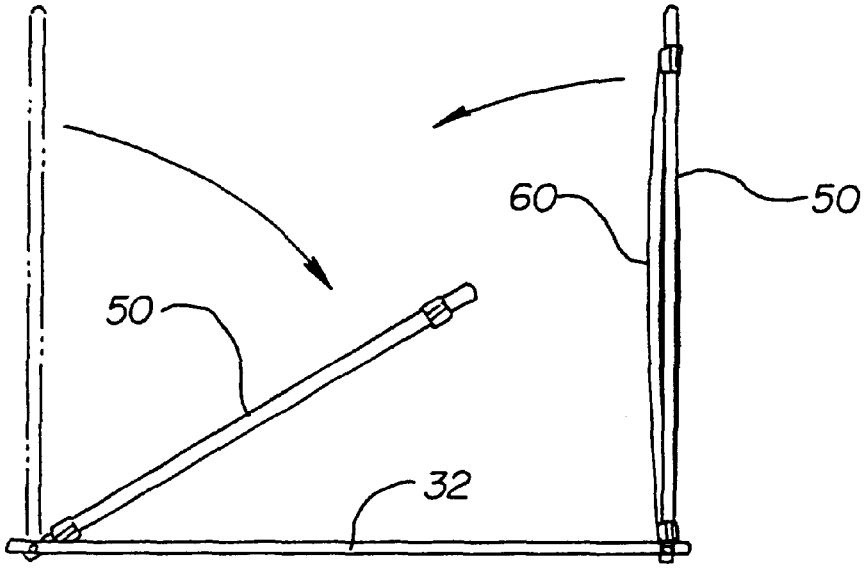
FIG. 8 is a side elevational view of the collapsed inverted U-shaped end supports being folded down into the sled base.

FIGS. 7 and 8 illustrate how the arcuate side bows 60 are folded inwardly upon the end supports 50 while the end supports 50 are folded downwardly into the sled floor. As is obvious, the camouflage fabric 12 will follow the frame 30 into its folded condition, as well as the frame's 30 upwardly bale-like shaped condition.

In operation, the wildlife observer or hunter simply drags the field blind 10 to its appropriate position for use. Equipment may be carried on top of the blind. Next, the inverted U-shaped end supports 50 are pivoted upwardly with the camouflage waterproof fabric 12 substantially draped thereover. Next, the top support strut 58 is secured to the top arch portions 56 of the end supports 50. Next, the arcuate side bows 60 are swung outwardly to complete the cylindrical shape and are secured into position by the side support struts 68 which simply snap on and off by snap on ends 70. The door frame 90 is brought down on the top so that the pivot ends 92 may be secured to the hinge 80 suitably by releasable pivot pin 84. The stretch cord 96 is then connected. The blind is now ready for use.

Figure 10:
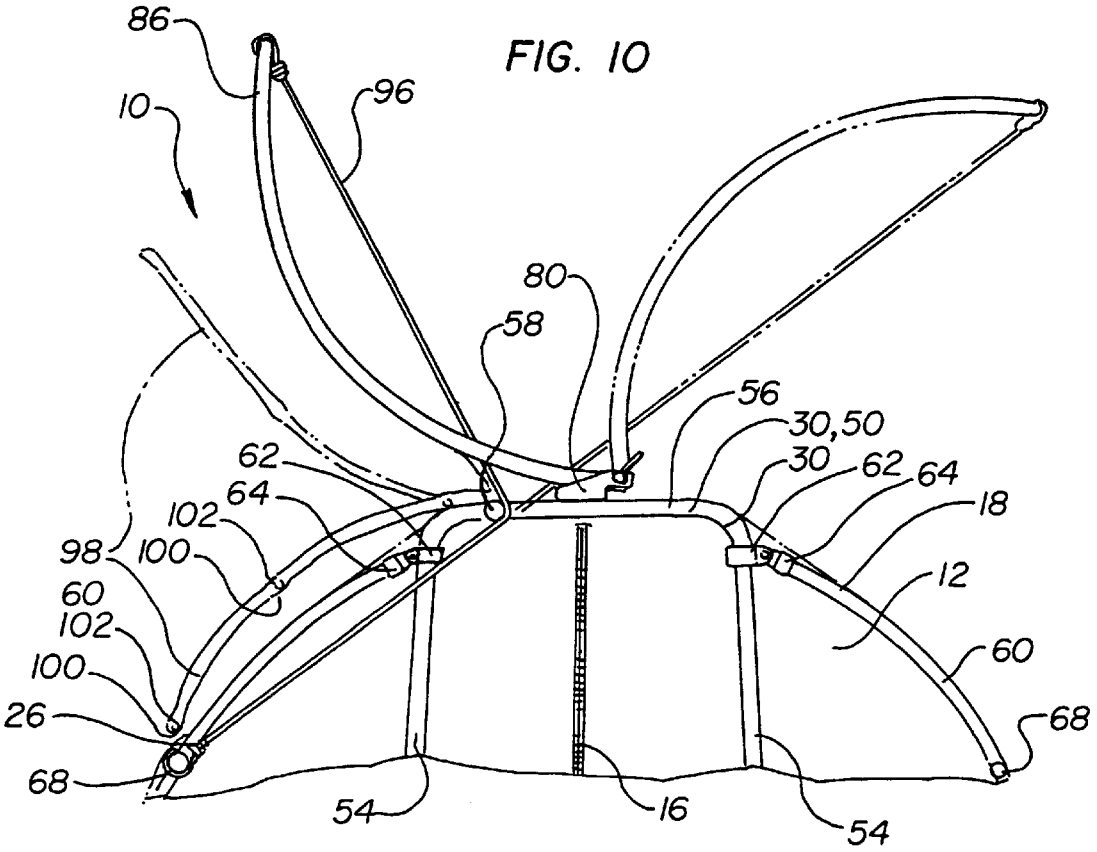
FIG. 10 is a side elevational view panially broken away showing the operation of the door.

The individual simply opens either the right or left zipper doors 14 or 16, which otherwise may be secured by VELCRO® or hook-loop materials. Pails or chairs may be placed within the blind suitable for sitting. Once in position within the blind, the doors 14 and/or 16 are secured closed. The individual within the blind may observe big game, water fowl or wildlife suitably through the front view slot 20, rear window 22, rear view slot 26 or end wall viewing slots 28. Alternatively or in addition, the camouflage material 12 may be a see through mesh 106 or door 86 and rear flap 24. Should the individual need to get up quickly, raise a gun and prepare to fire, the simple effort of beginning to stand and bumping the arcuate door frame 90, which is spring loaded, cause the door frame 70 to fly upwardly permitting hands free opening of the door 90. FIG. 10 illustrates the bias nature of this door frame 90 in that it is urged either fully open or fully closed in order to minimize the amount of stretching of the cord 96.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. A collapsible, portable, cylindrical bale-like field blind for hiding humans in a field, the blind comprising:

(a) a substantially rectangular base;

(b) a frame comprising two opposing inverted U-shaped end supports, each having two vertical sections pivotally mounted to the base for folding collapse inwardly toward the base;

(c) arcuate side bows pivotally mounted to each vertical section for pivotal motion inwardly for folding collapse of the end supports and for pivotal motion outwardly for completing the cylindrical bale-like shape;

(d) a support strut releasably supporting the frame in an upright condition; and (e) a blind cover securing over at least a portion of the frame.

2. The blind of claim 1 wherein the end supports have a top arch portion connecting the vertical sections.

3. The blind of claim 2 wherein the strut releasably connects the top arch portions.

4. The blind of claim 1 further comprising a blind covered arcuate door frame pivotally connected to top arch portions of the end supports and being biased to either an open position or a closed position.

5. The blind of claim 1 further comprising support struts releasably supporting the side bows in the outward location.

6. The blind of claim 1 where the support strut releasably supports a top arch portion of the inverted U-shaped end supports in the upright condition.

7. The blind of claim 1 further comprising closable doors in the blind cover adjacent the U-shaped end supports.

8. The blind of claim 1 further comprising a hatchway in the blind cover.

9. The blind of claim 1 further comprising viewing slots in the blind cover.

10. The blind of claim 1 wherein the base is a rectangular frame.

11. The blind of claim 1 wherein the base comprises a plastic floor with sidewalls.

12. A collapsible, portable, cylindrical bale-like field blind for hiding humans in a field, the blind comprising:

(a) a substantially rectangular base;

(b) a frame comprising two opposing inverted U-shaped end supports, each having two vertical sections pivotally mounted to the base for folding collapse inwardly toward the base;

(c) arcuate side bows pivotally mounted to each vertical section for pivotal motion inwardly for folding collapse of the end supports and for pivotal motion outwardly for completing the cylindrical bale-like shape;

(d) a support strut releasably supporting the frame in an upright condition;

(e) a blind cover securing over at least a portion of the frame; and (f) a blind covered arcuate door frame pivotally connected to top arch portions of the end supports and being biased to either an open position or a closed position.

13. The blind of claim 12 wherein the end supports have the top arch portion connecting the vertical sections.

14. The blind of claim 13 wherein the strut releasably connects the top arch portions.

15. The blind of claim 12 further comprising support struts releasably supporting the side bows in the outward location.

16. The blind of claim 12 where the support strut releasably supports the top arch portion of the inverted U-shaped end supports in the upright condition.

17. The blind of claim 12 further comprising closable doors in the blind cover adjacent the U-shaped end supports.

18. The blind of claim 12 further comprising a hatchway in the blind cover.

19. The blind of claim 12 further comprising viewing slots in the blind cover.

20. A collapsible, portable, cylindrical bale-like field blind for hiding humans in a field, the blind comprising:

(a) a substantially rectangular base;

(b) a frame comprising two opposing inverted U-shaped end supports, each having a top arch portion and two vertical sections pivotally mounted to the base for folding collapse inwardly toward the base;

(c) arcuate side bows pivotally mounted to each vertical section for pivotal motion inwardly for folding collapse of the end supports and for pivotal motion outwardly for completing the cylindrical bale-like shape;

(d) support struts releasably supporting the end supports in an upright condition and the side bows in an outwardly position;

(e) a blind cover securing over at least a portion of the frame with at least one door and viewing slots in the blind cover, a hatchway in the cover; and (f) a blind covered arcuate door frame pivotally connected to top arch portions of the end supports and being biased to either and open position or a closed position.

* * * * *